US005980131A

United States Patent [19]

Ishimoto

[11] Patent Number: 5,980,131

[45] Date of Patent: Nov. 9, 1999

[54] AUTOMATIC DEVELOPING APPARATUS FOR PHOTOSENSITIVE MATERIAL

[75] Inventor: Kenzo Ishimoto, Wakayama, Japan

[73] Assignee: Noritsu Koki Co., Ltd., Wakayama-ken, Japan

[21] Appl. No.: 09/123,267

[22] Filed: Jul. 28, 1998

[30] Foreign Application Priority Data

Jul. 29, 1997 [JP] Japan ..... 9-203429

[51] Int. Cl.[6] ..... G03D 3/02

[52] U.S. Cl. ..... 396/626; 396/630; 396/632

[58] Field of Search ..... 396/626, 630, 396/632; 137/115.02, 392; 417/200

[56] References Cited

U.S. PATENT DOCUMENTS 4,724,044 2/1988 Weishaar et al. ..... 396/626

4,806,962 2/1989 Uchida et al. ..... 396/630

*Primary Examiner*—D. Rutledge

*Attorney, Agent, or Firm*—Jordan and Hamburg LLP

[57] ABSTRACT

This invention is directed to an auto developing apparatus for a photosensitive material. The auto-developing-apparatus of this invention includes a treatment tank that is filled with a liquid; a supply unit for supplying the liquid to the treatment tank; a waste liquid tank for storing a waste liquid discharged from the treatment tank; a power supply line for supplying a drive power to the supply unit; and a shut down unit for disconnecting the power supply line when a liquid level in the waste liquid tank reached a predetermined level.

5 Claims, 5 Drawing Sheets

AUTOMATIC DEVELOPING APPARATUS FOR PHOTOSENSITIVE MATERIAL

BACKGROUND OF THE INVENTION

This invention relates to an automatic developing apparatus for developing a photosensitive material such as a photo film and a photographic paper by passing the photosensitive material through a treatment tank filled with a processing liquid.

Conventionally, an automatic developing apparatus for a photosensitive material (hereinafter referred to as an auto-developing-apparatus) comprises a plurality of treatment tanks, each of them filled with a processing liquid; a supply unit for supplying a water or the processing liquid to adjust a concentration of the processing liquid in the treatment tank; and a waste liquid tank for storing the waste liquid from the treatment tank due to the supply of the processing liquid or the water to the treatment tank. In this auto-developing-apparatus further comprises an alarm for generating a sound to notify an operator when the liquid level in the waste liquid tank reaches a predetermined level. Upon being notified by the alarm, the operator instructs the auto-developing-apparatus to stop its operation so as to prevent the waste liquid tank from overflowing and at the same time discharges the waste liquid from the waste liquid tank. After the discharging the waste liquid from the waste liquid tank is done, the operator commands a resume of the operation of the auto-developing-apparatus for resuming the development operation.

However, in the above described auto-developing-apparatus, it is not necessarily the case that the operator always instructs the halting of the operation of the auto-developing-apparatus at the time of alarm going off. In fact if the operator inadvertently forgets to give the command to halt the operation of the auto-developing-apparatus, the waste liquid overflows from the waste liquid tank. In order to cope with this human dependent alarm system, it is possible to include a CPU of a controller that controls the supplying operation of the supply unit when the liquid level in the waste liquid tank reaches a predetermined level. However, even with this countermeasure, there exists a possibility of malfunction of the controller due possibly to an external noise and an instantaneous power failing situation, leading to a continuous supply of the liquid to the treatment tank by the supply unit, resulting in overflowing the waste liquid from the waste liquid tank.

In view of the above, there is certainly room for improvement in designing the auto-developing-apparatus that enables a secure prevention of overflowing of the waste liquid from the waste liquid tank.

SUMMARY OF THE INVENTION

It is, therefore, an object of this invention to solve the aforementioned problems of the conventional apparatuses.

It is another object of this invention to provide an auto-developing-apparatus that securely prevents an overflowing of the waste liquid from the waste liquid tank.

In order to fulfill the above objects, according to this invention, an auto-developing-apparatus comprises a treatment tank that is filled with a liquid; a supply unit for supplying the liquid to the treatment tank; a waste liquid tank for storing a waste liquid discharged from the treatment tank; a power supply line for supplying a drive power to the supply unit; and a shut down unit for disconnecting the power supply line when a liquid level in the waste liquid tank reached a predetermined level.

By using the auto-developing-apparatus as described above, the processing liquid or the water is supplied to the treatment tank by driving the supply unit and because of this supply the waste liquid from the treatment tank is stored in the waste liquid tank. When the liquid level of the waste liquid tank reaches the predetermined level, the shut down unit is actuated to disconnect the power supply line, supplying the drive power to the supply unit, thereby the supplying operation of the supply unit is halted.

These and other objects, features and advantage of the present invention will become more apparent upon reading the following detailed description and accompanying drawings.

DETAILED DESCRIPTION OF THE PREFERRED EMBODIMENTS

Hereinafter, preferred embodiments of this invention are described in details along with the drawings.

Figure 1:
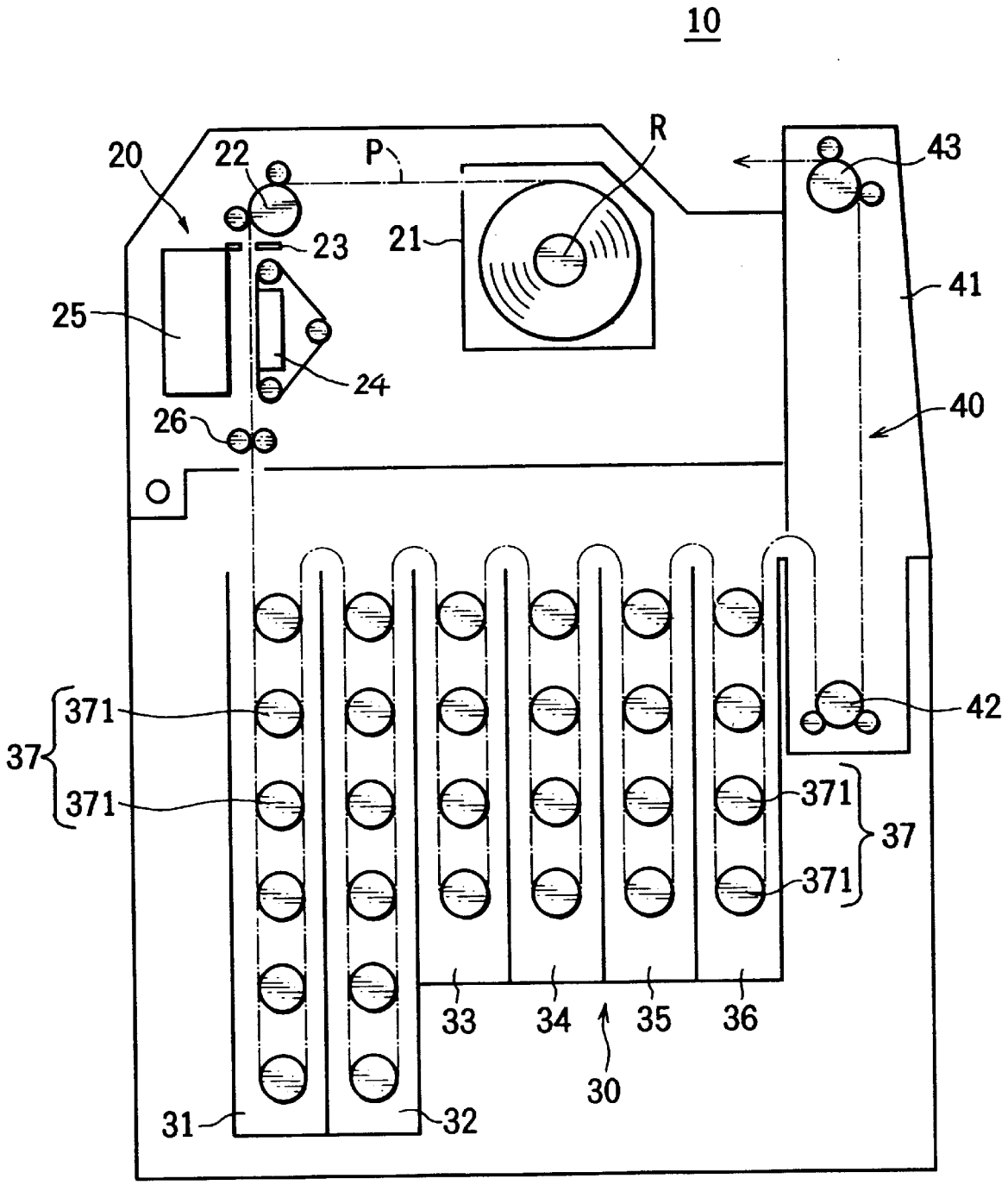
FIG. 1 is a schematic overview showing an auto-developing-apparatus for a photosensitive material in accordance with an embodiment of this invention.

FIG. 1 is a schematic overview showing an auto-developing-apparatus for a photosensitive material (hereinafter referred to simply as an auto-developing-apparatus) in accordance with an embodiment of this invention. In this figure, the auto-developing-apparatus 10 includes an exposure unit 20 disposed in an upper position, a developing unit 30 disposed in a lower position, and a drying unit 40 disposed in a front portion.

The exposure unit 20 includes a magazine 21 housing a roller R of a photosensitive material P as an elongated photographic paper, a transfer roller pair 22 transferring the photosensitive material P drawn out of the magazine 21 in a downstream side, a cutter 23 cutting the photosensitive material P into a certain length, a suction unit 24 for holding the photosensitive material P by the suction force, a film projection unit 25 for exposing/printing a film image onto the photosensitive material P held by the suction unit 24 and a transfer roller pair 26 transferring the exposed photosensitive material P to a developing unit 30.

The developing unit 30 includes a developing tank 31 filled with a developing liquid, a bleach fixing tank 32 filled with a bleach fixing solution, a first stabilizing tank 33 filled with a slurry, a second stabilizing tank 34, a third stabilizing tank 35 and a fourth stabilizing tank 36; all are arranged in series. Each of the treatment tanks 31, 32, 33, 34, 35, 36 includes a transfer roller unit consisting of a plurality of transfer rolls 371. With the aforementioned configuration, the exposed photosensitive material P is transferred by the transfer unit 37 from an upstream to a downstream; passing through the developing solution, the breach fixing solution, and the slurry in the order stated. The detailed construction of the developing unit 30 is explained in the later section.

The drying unit 40 includes an unillustrated heater and an unillustrated fan drawing a heat generated by the heater to a drying chamber 41. The photosensitive material P passing through the drying unit 40 is discharged through the transfer roller pair 42, 43.

Figure 2:
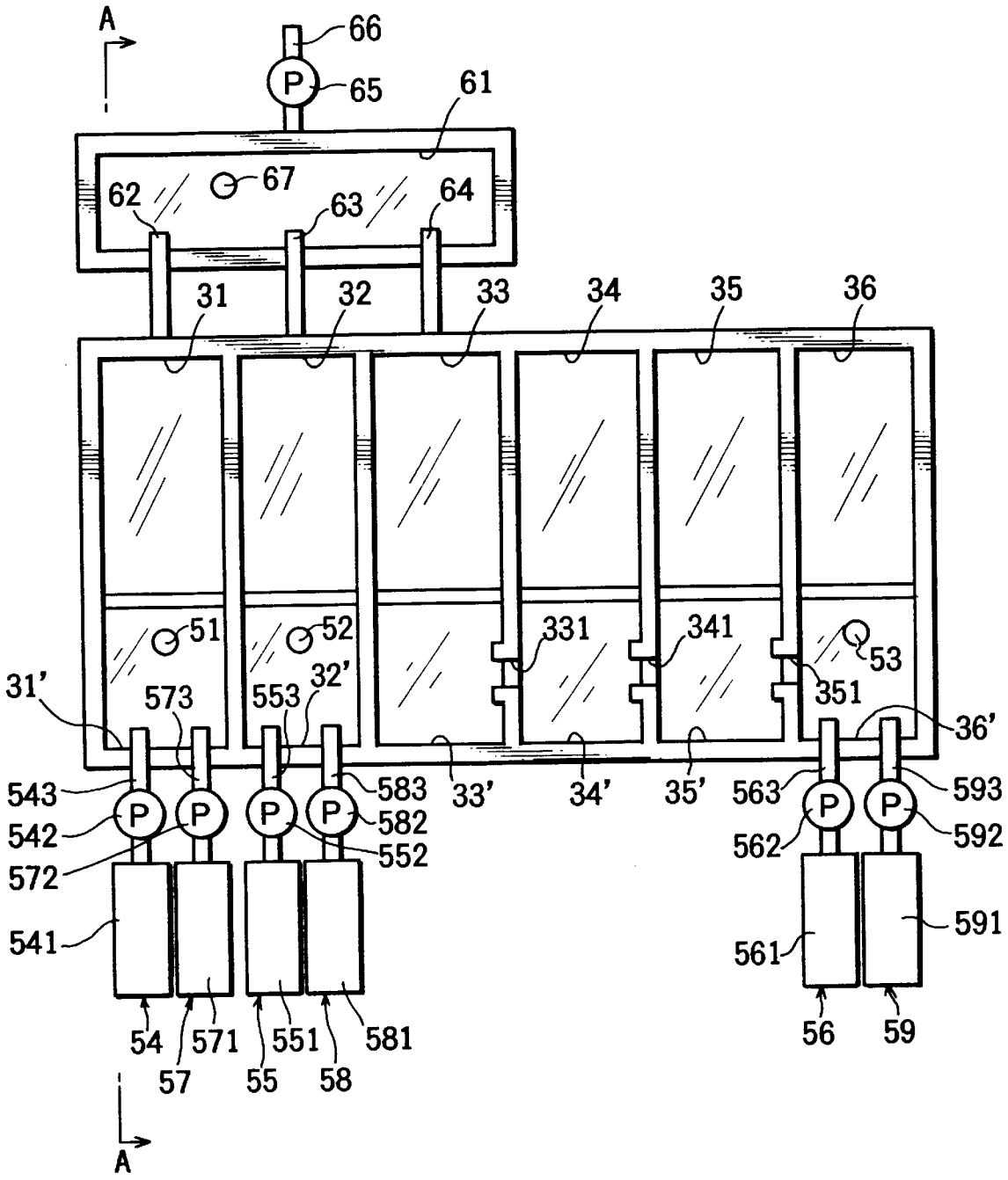
FIG. 2 is a plan view showing essentially a developing unit of the auto-developing-apparatus for the photosensitive material shown in FIG. 1.
Figure 3:
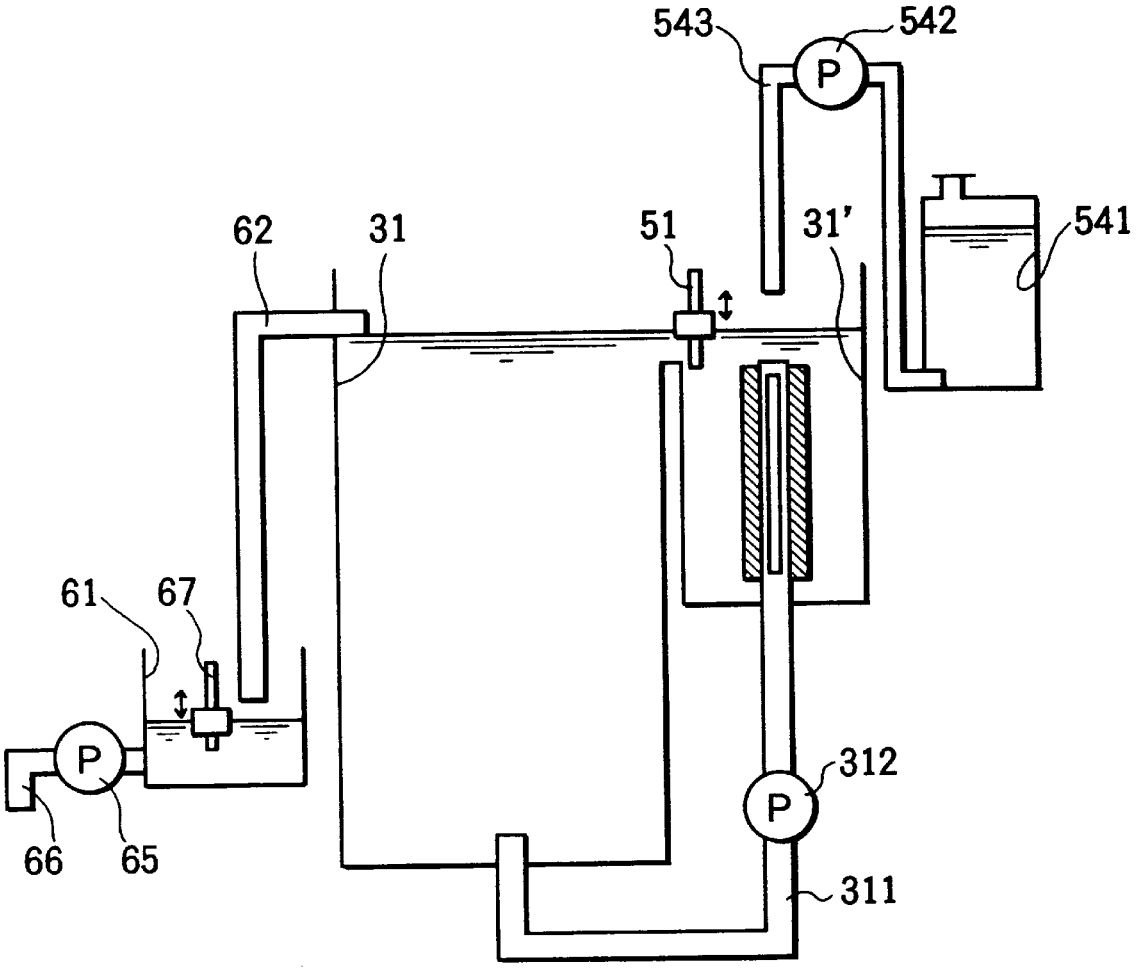
FIG. 3 is a cross sectional view taken along an A—A line of the auto-developing-apparatus in FIG. 2.

FIG. 2 is a plan view showing an essential part of the developing unit 30 and FIG. 3 is a vertical cross sectional view taken along an A—A line of FIG. 2. In these figures, each of the treatment tanks 31, 32, 33, 34, 35, 36 is in a top open arrangement. On the one side of the treatment tanks 31, 32, 33, 34, 35, 36, there respectively provided a developing sub-tank 31' filled with the developing solution, a breach fixing sub-tank 32' filled with the breach fixing solution, a first stabilizing sub-tank 33', a second stabilizing sub-tank 34', a third stabilizing sub-tank 35' and a forth stabilizing sub-tank 36' filled with slurry.

The aforementioned treatment sub-tanks, 31', 32', 33', 34', 35', 36' respectively form part of treatment tanks 31, 32, 33, 34, 35, 36. And all those sub-tanks, 31', 32', 33', 34', 35', 36' have top open structures. The first, second, third, and fourth stabilizing treatment tanks 33', 34', 35', 36' are formed with liquid passages 331, 341, 351 at the boundaries therebetween so that treatment liquid communicates between the treatment tanks 33', 34', 35', 36' through the respective passages 331, 341, 351.

Further, the developing tank 31 and the developing sub-tank 31' are communicated each other through a liquid supply pipe 311 connected to the bottom surfaces thereof and the treatment liquid circulates between the two tanks by a circulation pump 312 pumping the treatment liquid of the sub-tank 31' into the tank 31. The relationships between other treatment tanks 32, 33, 34, 35, 36 and the corresponding treatment sub-tanks 32', 33', 34', 35', 36' are in the same manner as described.

Further the developing sub-tank 31', the breach fixing sub-tank 32', and the fourth stabilizing sub-tank 36' are provided with liquid level sensors 51, 52, 53 respectively and are also provided with supply units 54, 55, 56 respectively. The supply unit 54 includes a supply tank 541 filled with the treatment liquid, a first pump 542, and a supply pipe 543. Thus the treatment liquid is supplied from the supply tank 541 to the developing sub-tank 31' by the first pump 542 through the supply pipe 543. The supply unit 55 includes a supply tank 551 filled with the treatment liquid, a second pump 552, and a supply pipe 553. Thus the treatment liquid is supplied from the supply tank 551 to the developing sub-tank 32' by the second pump 552 through the supply pipe 553. Similarly, the supply unit 56 includes a supply tank 561 filled with the treatment liquid, a third pump 562, and a supply pipe 563. Thus the treatment liquid is supplied from the supply tank 561 to the developing sub-tank 33' by the third pump 562 through the supply pipe 563. The liquid level sensors 51, 52, 53 each is of a cylindrical type configuration having a switch contact portion and a float that is vertically movable in accordance with the liquid level to magnetically open and close the switch contact portion.

In addition, in order to prevent the concentration of the liquid becoming too dense in case that the moisture evaporates, the developing sub-tank 31', the breach sub-tank 32' and the fourth stabilizing sub-tank 36' are respectively provided with supply units 57, 58, 59 for supplying water. The supply unit 57 includes a water supply tank 571 filled with water, a fourth pump 572, a supply pipe 573 and thus water is supplied from the water supply tank 571 to the developing sub-tank 31' by the fourth pump 572 through the supply pipe 573. Similarly, the supply unit 58 includes a water supply tank 581 filled with water, a fifth pump 582' a supply pipe 583 and thus water is supplied from the water supply tank 581 to the developing sub-tank 32' by the fifth pump 582 through the supply pipe 583. In the same way, the supply unit 59 includes a water supply tank 591 filled with water, a sixth pump 592, a supply pipe 593 and thus water is supplied from the water supply tank 591 to the developing sub-tank 33' by the sixth pump 592 through the supply pipe 593.

A waste liquid tank 61 is disposed adjacent to the developing tank 31, the bleach fixing tank 32, and the first stabilizing tank 33. Thus the waste liquid overflowing from the respective tanks 31, 32, 33 due to the supply of the treatment liquids by the supply units 54, 55, 56 is discharged and stored to/in the waste liquid tank 61 via the discharge pipes 62, 63, 64. The waste liquid tank 61 is provided with a discharge pump 65 and a discharge pipe 66 thereby the waste liquid stored in the waste liquid tank 61 can be discharged by the discharge pump 65 through the discharge pipe 66. In addition, the waste liquid tank 61 has a liquid level sensor 67 therein for detecting the level of the waste liquid in the waste liquid tank 61. Note that the liquid level sensor 67 may be the same configuration as the aforementioned liquid level sensors 51, 52, 53.

Figure 4:
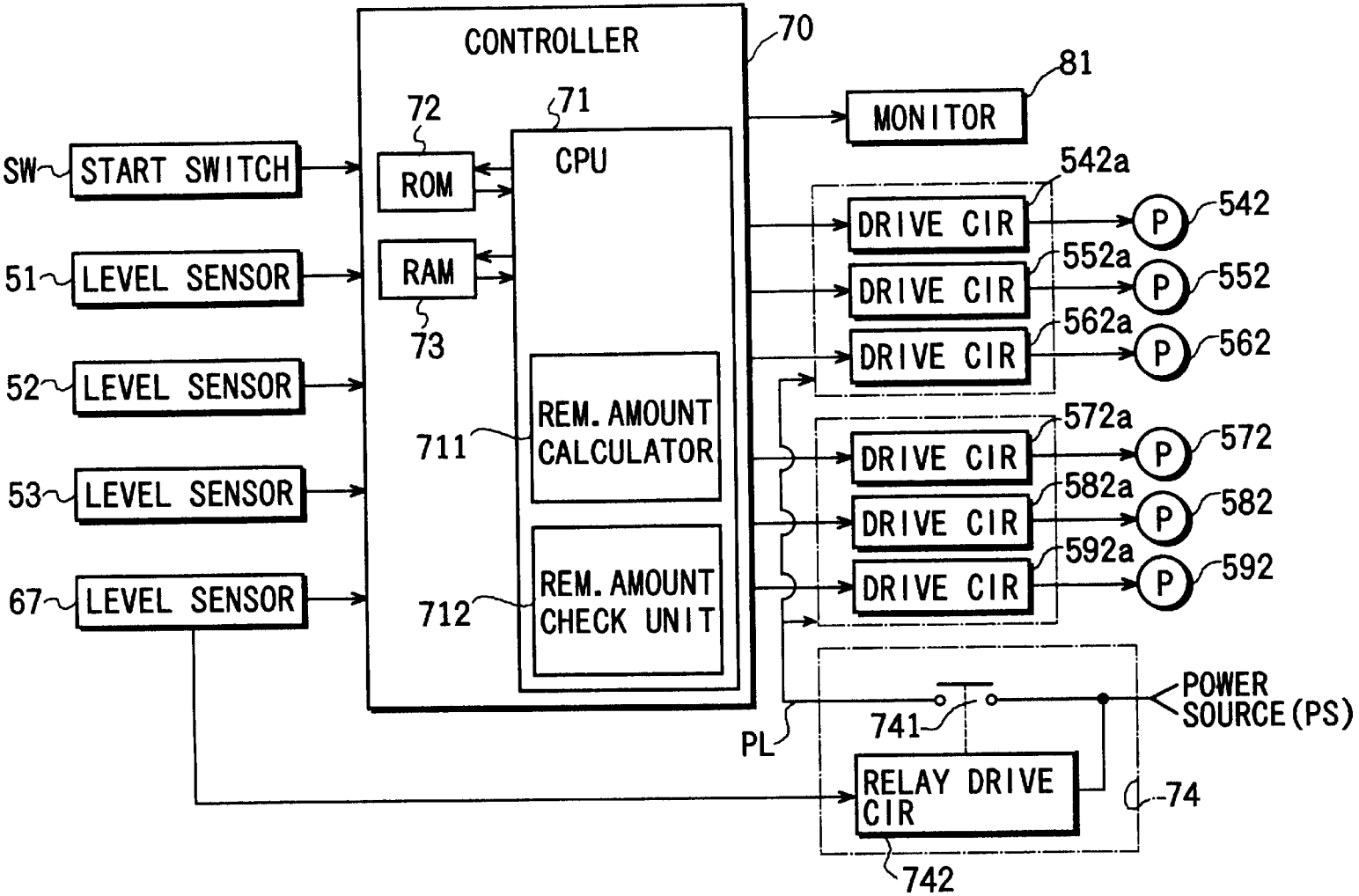
FIG. 4 is a block diagram showing a control system of the developing unit of the auto-developing-apparatus shown in FIG. 1.

FIG. 4 is a block diagram showing a control system of the developing unit 30. In this figure, the control system 70 (or simply controller) includes a CPU 71 for executing a predetermined processing, a ROM 72 storing a predetermined program, and a RAM 73 enabling a temporal storage of the data. The CPU 71 further includes a remaining supply amount calculating unit 711 for calculating the remaining amount of the treatment liquid to be supplied (a predetermined supply amount—already supplied amount) and a remaining supply amount check unit 712 for confirming if there exists a necessity of a supply of the remaining amount of the treatment liquid. The remaining supply amount calculating unit 711 calculates a remaining supply amount of the treatment liquid by subtracting the already supplied amount from the predetermined supply amount when the supply operation(s) of the treatment liquid(s) by either one of two or more of the supply units 57, 58, 59 is/are interrupted. The remaining supply amount check unit 712 also confirms if there exists the remaining supply of water left.

The controller 70 is connected with a start switch SW for driving the apparatus, a liquid sensor 51 in the developing sub-tank 31', a liquid level sensor 52 in the breach fixing sub-tank 32', a liquid level sensor 53 in the fourth stabilizing sub-tank 36', and a liquid level sensor 67 in the waste liquid tank 61 and corresponding detection signals are inputted to the controller 70. Furthermore, the controller 70 is connected with a drive circuit 542*a* for driving a first pump 542 of the supply unit 54, a drive circuit 552*a* for driving a second pump 552 of the supply unit 55, a drive circuit 562*a* for driving a third pump 562 of the supply unit 56, a drive circuit 572*a* for driving a fourth pump 572 of the supply unit 57, a drive circuit 582*a* for driving a fifth pump 582 of the supply unit 58, a drive circuit 592*a* for driving a sixth pump 592 of the supply unit 59 and a monitor 81 notifying the information regarding the liquid level in the waste liquid tank 61.

The drive circuits 542*a*, 552*a*, 562*a*, 572*a*, 582*a*, 592*a*, all are connected to a power source PS via a power supply line PL to drive the pumps 542, 552, 562, 572, 582, 592 respectively. The-power supply line PL is connected to a shut down unit 74 and the shut down unit 74 has a relay drive circuit 742 for controllably switchable between closed state and open state. This relay drive circuit 742 is controlled by a detection signal from the liquid level sensor 67 in the waste liquid tank 61.

In other words, when the liquid level in the waste liquid tank 61 reached a predetermined level, a certain detection signal is issued and by this signal the relay drive circuit 742 is actuated to open the relay contact portion 741, disconnecting the power supply line PL, resulting in halt of power supply from the power source PS to the respective drive circuits 542*a*, 552*a*, 562*a*, 572*a*, 582*a*, 592*a*. In this arrangement, even if a signal that demands the operation of each pump from the controller 70 is issued, the operation of the respective pumps 542, 552, 562, 572, 582, 592 are securely prevented.

Hereinafter, the operation of the aforementioned auto-developing-apparatus 10 for the photosensitive material P is described. 10 Specifically, when the start switch is turned on, film images are successively exposed to the photosensitive material P at the exposure unit 20 and then developed at the developing unit 30. Then as the quantity of photosensitive material P having been processed increases, each treatment liquid becomes contaminated, thus when the quantity of the photosensitive material P having been developed reaches a certain level, certain amounts of the treatment liquids are respectively supplied to the treatment sub-tanks 31', 32', 36' via the respective supply units 54, 55, 56. As the treatment liquid being supplied, the treatment liquids (as waste liquids) in the treatment tanks 31, 32, 33 overflow therefrom and these overflowed treatment liquids are discharged into the waste liquid tank 61.

Note that the certain level of the developed amount of the photosensitive material P can be measured by its length or by its area. In addition, it is also possible to measure the level of usage of the photosensitive material P by the operation hour of the apparatus or the time spent on transferring the photosensitive material P. Furthermore, in case the certain amount of treatment liquid does not exist in the treatment tanks 31, 32, 36 at the time the start switch SW is turned on, the liquid level sensors 51, 52, 53 issue signals and the monitor 81 display the present state therein and at the same time the water is supplied to the treatment sub-tanks 31', 32' 36' from the water supply units 57, 58, 59.

The respective supply units 54, 55, 56 supply the treatment liquids upon reaching the certain usage level of the photosensitive material P, subsequently, the waste liquid stored in the waste liquid tank 61 reaches the predetermined level. When the waste liquid stored in the waste liquid tank 61 reached the predetermined level, the liquid level sensor 67 issues the detection signal and thereafter the information regarding the liquid level such as that the waste liquid level reached the predetermined level is notified with the operator. At the same time, the relay drive circuit 742 is actuated to open the relay contact 741 to shut down the power supply line PL, resulting in halting the power supply to the respective power circuits 542*a*, 552*a*, 562*a*, 572*a*, 582*a*, 592*a* from the power source PS. With this circuit arrangement, despite the fact that the command to supply the treatment liquid is issued from the controller 70, none of the pumps 542, 552, 562 operate, hence, the waste liquid is not discharged from the treatment tanks 31, 32, 33 into the waste liquid tank 61. As a result, the waste liquid is prevented from overflowing from the top rim of the waste liquid tank 61.

Thereafter, when the operator discharges the waste liquid from the waste liquid tank 61 by operating the discharge pump 65 and waste liquid level comes under the predetermined level, the liquid sensor 67 issues the detection signal and by this signal the relay drive circuit 742 is actuated to close the relay contact 741 to restore the shut down power supply line PL, enabling resuming the power supply from the power source PS to the respective power circuits 542*a*, 552*a*, 562*a*, 572*a*, 582*a*, 592*a*. As a result, each of pumps 542, 552, 562 is in the ready state to supply the respective treatment liquid upon receiving the command to do so from the controller 70.

When the waste liquid level in the waste liquid tank 61 reaches the predetermined level during the supplying operation of the treatment liquid from the respective supply units 54, 55, 56, the supplying operation of the treatment liquid is halted. At this moment, the remaining supply amount of the treatment liquid is calculated by subtracting the already supplied amount of the treatment liquid from the predetermined supply amount of the treatment liquid and this calculated remaining supply amount of the treatment liquid is stored in the RAM 73. Thus at the time the power supply from the power source PS is resumed by resetting the disconnection of the power supply line PL, the stored data of remaining supply amount in the RAM 73 is recalled to check if the remaining supply amount is present or not by the remaining supply amount check unit 712. Then if the remaining supply amount is found to be present, at the time the power supply from the power source PS is resumed, the treatment liquid is resumed to be supplied by the amount corresponding to the remaining supply amount stored in the RAM 73. If the remaining supply amount is found to be absent, the system simply waits for the next command issued from the controller 70. The supply amount of the treatment liquid can be measured in terms of the pump speed and the pump's working hour. However, more accurate data is needed, use of such as a float-meter that directly measures the flow amount is recommended.

In the above described embodiment of the auto-developing-apparatus 10 for the photosensitive material of this invention, the water supply units 57, 58, 59 for adjusting the concentration of the treatment liquid are set to supply certain amount of water to respective treatment sub-tanks 31', 32', 36' at the start up time of the auto-developing-apparatus 10. Accordingly, at this start up time, when the liquid level in the waste liquid tank 61 has already reached the predetermined level and the power supply line PL has been already disconnected, then none of the pumps 572, 582, 592 is in operable condition and thus waste liquids are not discharged from the respective treatment tanks 31, 32, 33. As a result, the waste liquid is prevented from overflowing the waste liquid tank 61.

As mentioned in the foregoing passages, the auto-developing-apparatus 10 for the photosensitive material of this invention includes a shut down unit 74 which disconnects the power supply line PL, disabling the power supply to the supply units 55, 56, 57, 58, 59, from the power source PS when the liquid level in the waste liquid tank 61 reaches the predetermined level. This enables a secure prevention of overflowing of the waste liquid from the waste liquid tank 61. Furthermore, since the operations of the supply units 54,55,56,57,58,59 are disabled by disconnecting the power supply line PL, it is possible to eliminate the likeliness with the apparatus using the software dependent overflow prevention mechanism in that a malfunction of the CPU of the control system may occur due to an external noise or an instantaneous power black out, resulting in the improper operations of the supply units 54, 55, 56, 57, 58, 59. Thus the way this embodiment used to disconnect the power supply to the supply units is much simpler and more reliable in comparison to the above described software dependent overflow prevention mechanism.

Figure 5:
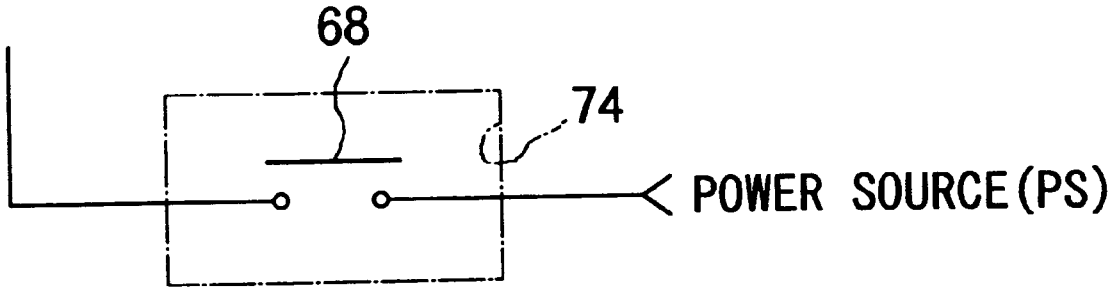
FIG. 5 is a diagram showing only another configuration of a particular part of the control system shown in FIG. 4.

Alternate forms of the auto-developing-apparatus of this invention are described in the following:

(1) In the aforementioned embodiment, the shut down unit includes the relay contact 741 which is directly connected to the power source PS, and the relay drive circuit 742 for opening/closing the relay contact 741 to disconnect the power supply line PL. However, this invention is not limited to this arrangement, the shut down unit 74 may be in the form shown in FIG. 5. Specifically, a flow-switch 68 similar to the liquid level sensor 67 may be connected to the power supply line PL in series. The flow-switch 68 may include a float with a magnet which is movable in a vertical direction in accordance with the liquid level to open/close the electrical switch contact. Thus with this flow-switch arranged in series along with the power supply line PL, the switch contact is set open when the liquid level in the waste liquid tank 61 reaches the predetermined level.

Furthermore, it is also possible to place a semiconductor switch such as SCR in the power supply line in series to disconnect the power supply line PL by actuating the semiconductor switch upon receiving the detection signal from the liquid level sensor 67.

In other words, all we need for the shut down unit are elements such as, a detection unit for detecting the liquid level in the waste liquid level; and a switch unit for switching from closed state to open state upon receiving the detection signal from the detection unit when the liquid level reaches the predetermined level. Another form of the shut down unit needs a switch unit that is placed in the power supply line in series and which is self switchable from the closed state to the open state when the liquid level in the waste liquid tank reaches the predetermined level.

Moreover, for the detection unit and the switch unit, in addition to the aforementioned magnetic type or semiconductor type, it is possible to use a mechanically operable type which open/close the contact mechanically; another type utilizing the variation of resistance such as a thermistor, yet another type utilizing the volume variation such as a condenser, an optical type utilizing a difference between liquid and vacuum in refraction index and so forth.

(2) In the aforementioned embodiment, the treatment liquid is supplied in accordance with the amount of developed photosensitive material P and water is supplied when the concentration of the treatment liquid becomes dense. However, this invention is not limited to this arrangement, but it is possible to set the supply rate of the treatment liquid and the water constant during the operation of the auto-developing-apparatus. In this arrangement, the remaining supply amount of the treatment liquid is not necessarily calculated all the time when the supply operation of the treatment liquids by the supply units is interrupted. Instead, it may be possible to resume a supplying operation at a constant rate that is the same as the rate set before when the supply units are resumed their operations. Note that the rate of supplying the treatment liquid or the rate of supplying water should be adequately set to maintain the operation of the auto-developing-apparatus in an efficient manner.

(3) In the aforementioned embodiment, the remaining supply amounts of the treatment liquid and the water calculated by the remaining supply amount calculator 711 are automatically stored in the RAM 73. However, this invention is not limited to this arrangement, but it is possible to have an input means such as a keyboard through which the operator punches in the calculated remaining supply amount that is to be stored in the RAM. Here, the remaining supply amount can be obtained by the operator in accordance with the pump speed (RPM). In calculating the remaining supply amount, such as mathematical table as a calculation base such as a pump speed is preferably displayed on a display means. Accordingly, in this invention, this display means is considered to be one of the members for the remaining supply amount calculator.

(4) In the aforementioned embodiment, the power supply line PL for supplying the power source to the treatment liquid supply units 54, 55, 56 and the power supply line PL for supplying the power source to the water supply units 57, 58, 59 are both set to be disconnected but this invention is not limited to this arrangement. In fact, it is possible to disconnect only the power supply line PL for supplying the power source to the treatment liquid supply units 54, 55, 56. Moreover, in the aforementioned embodiment, the water supply units 57, 58, 59 are set to supply water from the water tanks 571, 581, 591; however, it may be possible to set to supply water from a pressured water supply source such as a water faucet. In this later case, the pumps 572, 582, 592 are replaced with electromagnetic valves.

(5) In the aforementioned embodiment, the monitor 81 is used as an alarm unit to notify the information regarding the liquid level in the waste liquid tank. However, other types of alarm units such as a lamp and buzzer may also be usable.

(6) In the aforementioned embodiment, the operator manually operates the discharge pump 65 upon activating the start up switch to discharge the waste liquid from the waste liquid tank 61. However, it may be possible to set such that the discharge pump 65 is operated by the controller 70 in accordance with the detection signal from the liquid level sensor 67 to automatically discharge the waste liquid. In this later case, the monitor 81 may be excluded.

(7) In the aforementioned embodiment, the waste liquids from the treatment tanks 31, 32, 33 are all discharged into the same waste liquid tank 61. However, it may be also possible to provide individual waste tank for respective treatment tanks 31, 32, 33 or provide a common tank for the treatment tanks 31, 32 and a separate tank for the treatment tank 33. When the plural waste tanks are used, a liquid level sensor is provided to each of the plural tanks. Furthermore, it is also possible to set such that when one of the liquid level sensors reaches the predetermined level, operations of all the supply units are halted. Yet, moreover, it is also possible to set such that operation of only the supply unit corresponding to the waste liquid tank whose liquid level has reached the predetermined level is halted.

(8) In the aforementioned embodiment, the invention is applied to the developing process of the printing paper as the photosensitive material; however, the invention can also be applied to the development of a film as the photosensitive material. It is also possible to apply this invention to an apparatus having a function of developing both a printing paper and a film.

Summing up the aforementioned disclosure, we had an auto-developing-apparatus for a photosensitive material which comprises: a treatment tank that is filled with a liquid; a supply unit for supplying the liquid to the treatment tank; a waste liquid tank for storing a waste liquid discharged from the treatment tank; a power supply line for supplying a drive power to the supply unit; and a shut down unit for shutting down the drive power supply by the power supply line when a liquid level in the waste liquid tank reached a predetermined level.

With the aforementioned structure, the liquid level in the waste liquid tank reaches the predetermined level, the power supply line for supplying the power to the supply unit is disconnected by the shut down unit. Thus the waste liquid is securely prevented from over flowing from the waste liquid tank.

The shut down unit may include a detecting unit for detecting the liquid level in the waste liquid tank and a switch unit that is placed in the power supply line in series for switching from a closed state, where the drive power supply of the power supply line is enabled, to an open state, where the power supply line is disconnected, in response to an output from the detecting unit when the liquid-level reaches the predetermined level.

With this structure, even when the huge current flows in the electric circuit, the shut-down of the power supply along the power supply line is securely executed.

The shut down unit may include a self-operating switch unit for switching from a closed state where the drive power supply of the power supply line is enabled to an open state where the power supply line is disconnected when the liquid level in the waste liquid tank reaches the predetermined level.

With this structure, the shut-down unit is placed in the power supply line in a series manner and includes the self-operating type switch unit which changes from its closed state to its open state by itself thus it can simplify the structure of the shut-down unit.

The auto-developing-apparatus further comprises an alarm for notifying liquid level related information when the liquid level in the waste liquid tank reaches the predetermined level.

With the above arrangement, the discharging operation of the waste liquid can be performed as soon as the alarm notifies that the liquid level in the waste liquid tank reached the predetermined level.

The auto-developing-apparatus may further comprise a control unit for driving the supply unit and wherein the control unit including a remaining supply amount calculator for calculating supply amount supply amount of the liquid when the liquid supply from the supply unit is stopped by disconnection of the power supply line and a memory for storing the calculated remaining supply amount thereby the control unit driving the supply unit in such a manner that the supply unit supplying the liquid to the treatment tank in accordance with the remaining supply amount stored in the memory when the disconnected state of the power supply line is reset.

With the above configuration, the previous operation, supplying the treatment liquid, that was interrupted by whatever the reasons can be restored and the total down time can be minimized.

Although the present invention has been fully described by way of examples with reference to the accompanying drawings, it is to be understood that various changes and modifications will be apparent to those skilled in the art. Therefore, unless otherwise such changes and modifications depart from the scope of the present invention, they should be constructed as being therein.

What is claimed is:

1. An auto developing apparatus for a photosensitive material comprising:

a treatment tank filled with a liquid;

a supply unit for supplying the liquid to the treatment tank;

a waste liquid tank for storing a waste liquid discharged from the treatment tank;

a power supply line for supplying a drive power to the supply unit; and a shut down unit for disconnecting the power supply line when a liquid level in the waste liquid tank reached a predetermined level.

2. The auto developing apparatus as defined in claim 1, wherein the shut down unit including a detecting unit for detecting the liquid level in the waste liquid tank and a switch unit that is placed in the power supply line in series for switching from a closed state, where the drive power supply of the power supply line is enabled, to an open state, where the power supply line is disconnected, in response to an output from the detecting unit when the liquid level reaches the predetermined level.

3. The auto developing apparatus as defined in claim 1, wherein the shut down unit including a self-operating switch unit for switching from a closed state, where the drive power supply along the power supply line is enabled, to an open state, where the power supply line is disconnected, when the liquid level in the waste liquid tank reaches the predetermined level.

4. The auto developing apparatus as defined in claim 1, further comprising an alarm for notifying liquid level related information when the liquid level in the waste liquid tank reaches the predetermined level.

5. The auto developing apparatus as defined in one of claims 1–4, further comprising a control unit for driving the supply unit and wherein the control unit including a remaining supply amount calculator for calculating the remaining supply amount of the liquid when the liquid supply from the supply unit is stopped by the disconnection of the power supply line and a memory for storing the calculated remaining supply amount thereby the control unit driving the supply unit in such a manner that the supply unit supplying the liquid to the treatment tank in accordance with the remaining supply amount stored in the memory when the disconnection of the power supply line is reset.

* * * * *